United States Patent [19]

Yamato et al.

[11] Patent Number: 4,459,962

[45] Date of Patent: Jul. 17, 1984

[54] METHOD FOR CONTROLLING FUEL SUPPLY TO AN INTERNAL COMBUSTION ENGINE AT DECELERATION

[75] Inventors: Akihiro Yamato, Shiki; Shigeo Umesaki, Iruma, both of Japan

[73] Assignee: Honda Motor Co., Ltd., Tokyo, Japan

[21] Appl. No.: 494,359

[22] Filed: May 13, 1983

[30] Foreign Application Priority Data

May 18, 1982 [JP] Japan ..... 57-83598

[51] Int. Cl.[3] ..... F02D 5/02

[52] U.S. Cl. ..... 123/493; 123/325

[58] Field of Search ..... 123/325, 332, 333, 339, 123/493

[56] References Cited

U.S. PATENT DOCUMENTS

| | | | |
|---|---|---|---|
| 3,483,851 | 12/1969 | Reichardt | 123/483 |
| 4,204,483 | 5/1980 | Harada et al. | 123/493 |
| 4,354,472 | 10/1982 | Knapp et al. | 123/493 |
| 4,385,596 | 5/1983 | Hosaka | 123/325 |
| 4,416,240 | 11/1983 | Matsuoka | 123/325 |

*Primary Examiner*—William A. Cuchlinski, Jr.
*Attorney, Agent, or Firm*—Arthur L. Lessler

[57] ABSTRACT

A fuel supply control method for controlling the fuel supply to an internal combustion engine at deceleration, wherein the valve opening of a throttle valve of the engine is detected while the throttle valve is being closed and each time each pulse of a predetermined sampling signal is generated, a variation in the same valve opening occurring between adjacent pulses of the sampling signal is determined as a control parameter value, and the fuel supply to the engine is interrupted in dependence upon the control parameter value. The above interruption of fuel supply to the engine is carried out during either of the following intervals of time: (a) a period of time during which it is determined that the value of the control parameter obtained at the time of generation of a present pulse of the sampling signal is smaller than a predetermined negative value and at the same time it is smaller than the value of the control parameter obtained at the time of generation of the preceding pulse of the sampling signal, and (b) a period of time starting from a time it is determined for the first time that the value of the control parameter at the present pulse of the sampling signal has become larger than the value of the control parameter at the preceding pulse of the sampling signal while at the same time the former is smaller than the aforementioned predetermined negative value, until a first predetermined period of time elapses.

4 Claims, 15 Drawing Figures

FIRST PROGRAM
1
SECOND PROGRAM
2
START CONTROL
3
BASIC CONTROL
4
ASYNCHRONOUS CONTROL
5
TICRM,TICRS TABLES
6,7
KNe TABLE
8
TV TABLE
9
BASIC Ti MAP
10
ACC/DEC SUBROUTINE
11
COEFFICIENT CALCULATING TABLES, SUBROUTINES
12
TV TABLE
9
TiA TABLE
13
KTW TABLE
14
TV TABLE
9

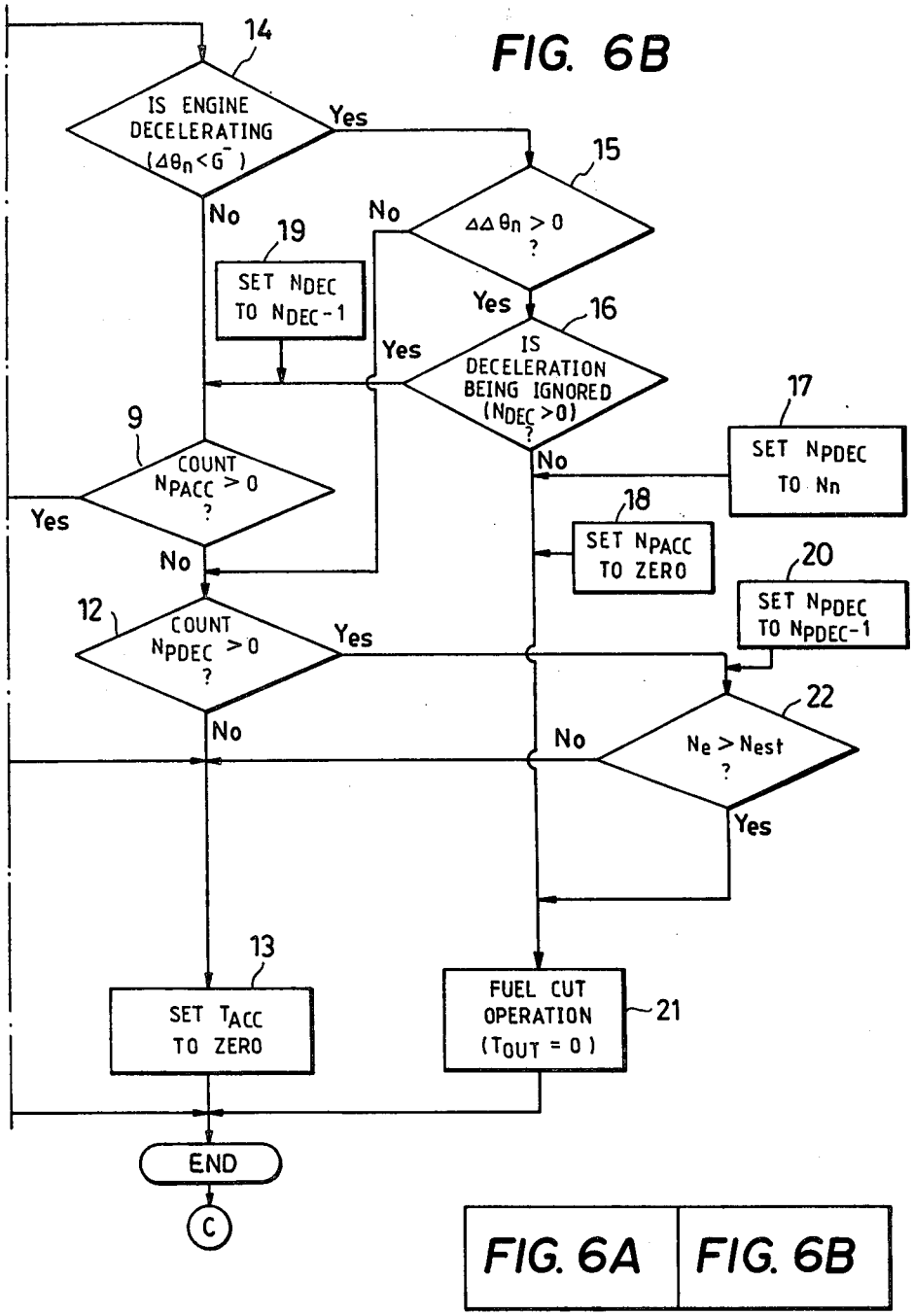
| FIG. 6A | FIG. 6B |
|---|---|

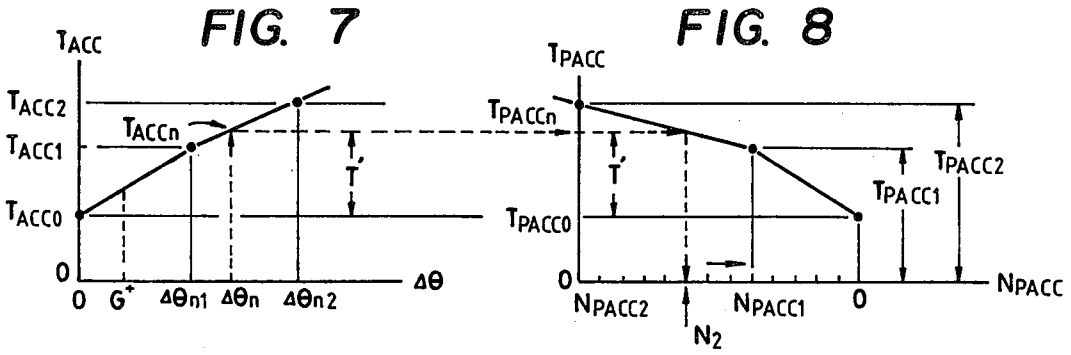
FIG. 7
TACC
TACC2
TACC1
TACC0
TACCn
0
G+
Δθn1
Δθn
Δθn2
Δθ
FIG. 8
TPACC
TPACCn
TPACC0
TPACC2
TPACC1
NPACC
NPACC1
NPACC2
N2
0
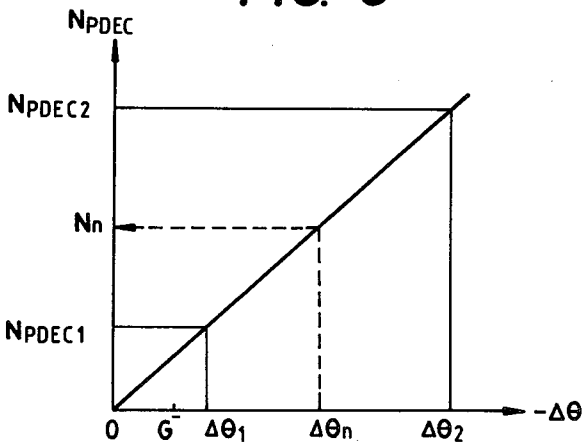
FIG. 9
NPDEC
NPDEC2
Nn
NPDEC1
0
G−
Δθ1
Δθn
Δθ2
−Δθ

TO 519
556
552
540
541c
554
555
541
M7<N7
M7
N7
541b
541a
CP3
550
538
B
CK
L
DOWN COUNTER
DIN
NEST MEMORY
537
NE REGISTER
503
535
545
544
CP2

θTH REGISTER
M3 - N3
θn - 1 REGISTER
Δθn - 1 REGISTER
Δθn REGISTER
VALUE OF ZERO MEMORY
M5 ≦ N5
M9 - N9
NPDEC MEMORY
M4 ≧ N4
M4 < N4
NDECO MEMORY
DOWN COUNTER
M8 > N8
M8 ≦ N8
G⁻ MEMORY
G⁺ MEMORY
PDECA
CP1
CP4
CP0
512
509
525
525a
525b
526
526a
526b
526c
527
527a
527b
528
528a
528b
529
529a
529b
529c
530
531
531a
531b
531c
531d
533
534
542
543
545
546
547
549
549a
549b
549c
549d
551a
551b
553
557
557a
557b
558

METHOD FOR CONTROLLING FUEL SUPPLY TO AN INTERNAL COMBUSTION ENGINE AT DECELERATION

BACKGROUND OF THE INVENTION

This invention relates to a control method for controlling the fuel supply to an internal combustion engine at deceleration, and more particularly to such a method in which the supply of fuel to the engine is interrupted in a manner adapted to the actual engine operating condition while the engine is decelerating, to thereby improve the emission characteristics and fuel consumption of the engine.

A fuel supply control system adapted for use with an internal combustion engine, particularly a gasoline engine has been proposed e.g. by U.S. Pat. No. 3,483,851, which is adapted to determine the valve opening period of a fuel quantity metering or adjusting means for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed control system, if the setting of the fuel supply quantity is made on the basis of such basic value as a function of the engine rpm and the absolute pressure in the intake passage of the engine, in the above explained manner, independently of a sudden reduction in the supply of supplementary air to the engine due to the closing of the throttle valve at engine deceleration, there can occur an excessive supply of fuel to the engine due to a time lag in the amount of drop in the absolute pressure in the intake passage of the engine corresponding to changes in the throttle valve opening. That is, when the throttle valve is abruptly closed, the drop in the absolute pressure in the intake passage can not at once follow such a change in the throttle valve opening, and the absolute pressure in the intake passage continues to drop even after the throttle valve has completely been closed. Also, there can occur a delay in the detection of the actual absolute pressure in the intake passage due to a time lag occurring in the absolute pressure detecting sensor means to respond to the actual absolute pressure in the intake passage.

On such occasion, it is advisable to interrupt the fuel supply to the engine at deceleration, in order to improve the fuel consumption and emission characteristics of the engine. If the condition for fuel cut is set in response to a change in the valve opening value of the throttle valve of the engine at deceleration while the above throttle valve is being closed, such fuel cut is terminated even before the absolute pressure in the intake passage of the engine drops to a sufficiently low level, by the reasons stated above, resulting in the air/fuel mixture being supplied to the engine becoming overrich, due to discontinuation of the above fuel cut after the full closing of the throttle valve, thereby badly affecting the emission characteristics and fuel consumption of the engine.

OBJECT AND SUMMARY OF THE INVENTION

It is the object of the invention to provide a fuel supply control method for an internal combustion engine at deceleration, which controls the fuel supply to the engine at deceleration in a manner compensating for the time lag of the changes in absolute pressure in the intake passage of the engine, which varies in proportion to the rate of change in throttle valve opening so as to interrupt the supply of fuel to the engine in a way appropriate to the actual operating condition of the engine, thereby preventing degradation in the emission characteristics and fuel consumption of the engine.

The fuel supply control method for an internal combustion engine according to this invention comprises the following steps: (1) detecting a throttle valve opening value while the throttle valve is being closed, each time each pulse of a predetermined sampling signal is generated, (2) determining as a control parameter the difference between a throttle valve opening value determined at the time of generation of each pulse of the sampling signal and one determined at the time of generation of the preceding pulse, (3) comparing the value of the above control parameter with a predetermined negative value, (4) comparing a value of the control parameter determined at present pulse of the sampling signal with one determined at the time of generation of the preceding pulse of the sampling signal, and (5) interrupting fuel supply to the engine during either of the following intervals of time in dependence upon results of the comparisons at the above steps (3) and (4): (a) a period of time during which it is determined that the value of the control parameter determined at the time of generation of a present pulse of the sampling signal is smaller than the aforementioned predetermined negative value and at the same time, it is smaller than the value of the control parameter determined at the time of generation of the preceding pulse of the sampling signal, and (b) a period of time starting from the time it is determined for the first time that the value of the control parameter at the present pulse of the sampling signal has exceeded the value of the control parameter at the preceding pulse of the sampling signal while at the same time, the value of the control parameter at the present pulse is smaller than the aforementioned negative value, until a first predetermined period of time elapses. In this way, it is not only possible to prevent degradation in the emission characteristics of the engine but also to improve the fuel consumption of the engine, t deceleration of the engine.

Preferably, the above first predetermined period of time is set to a value corresponding to the value of the control parameter determined at a time when it is determined for the first time that the value of the control parameter at the present pulse of the sampling signal has exceeded the value of the control parameter at the preceding pulse of the sampling signal.

More specifically, it is so arranged as to start the interruption of the fuel supply to the engine after the lapse of a second predetermined period of time from a time it is determined for the first time that the value of the above control parameter at the present pulse of the sampling signal has become smaller than the aforementioned predetermined negative value. Thus, the phenomenon can be avoided that the fuel supply to the engine is interrupted on a wrong judgement that the engine is decelerating, for instance, in the event that while the driver is accelerating the engine, he returns the accelerator pedal by a slight amount from its stepped-on position even for a very short time after having stepped on the accelerator pedal to accelerate the engine, causing an interruption in the fuel supply to the engine and thereby deteriorating the driveability of the engine.

BRIEF DESCRIPTION OF THE DRAWINGS

FIGS. 6A and 6B are a flow chart of a subroutine of control in synchronism with the TDC signals for calculating acceleration and post-acceleration fuel supply increasing constants TACC and TPACC and a subroutine for fuel cut at deceleration of the engine;

FIG. 7 is a table showing the relationship between the throttle valve variation $\Delta\theta$ and the acceleration fuel supply increasing constant TACC;

FIG. 8 is a table showing the relationship between post-acceleration TDC signal pulse count NPACC and the post-acceleration fuel supply increasing constant TPACC;

FIG. 9 is a table showing the relationship between the throttle valve opening valve variations $\Delta\theta$ and a post-deceleration count NPDEC;

DETAILED DESCRIPTION

The present invention will now be described in detail with reference to the drawings.

Figure 1:
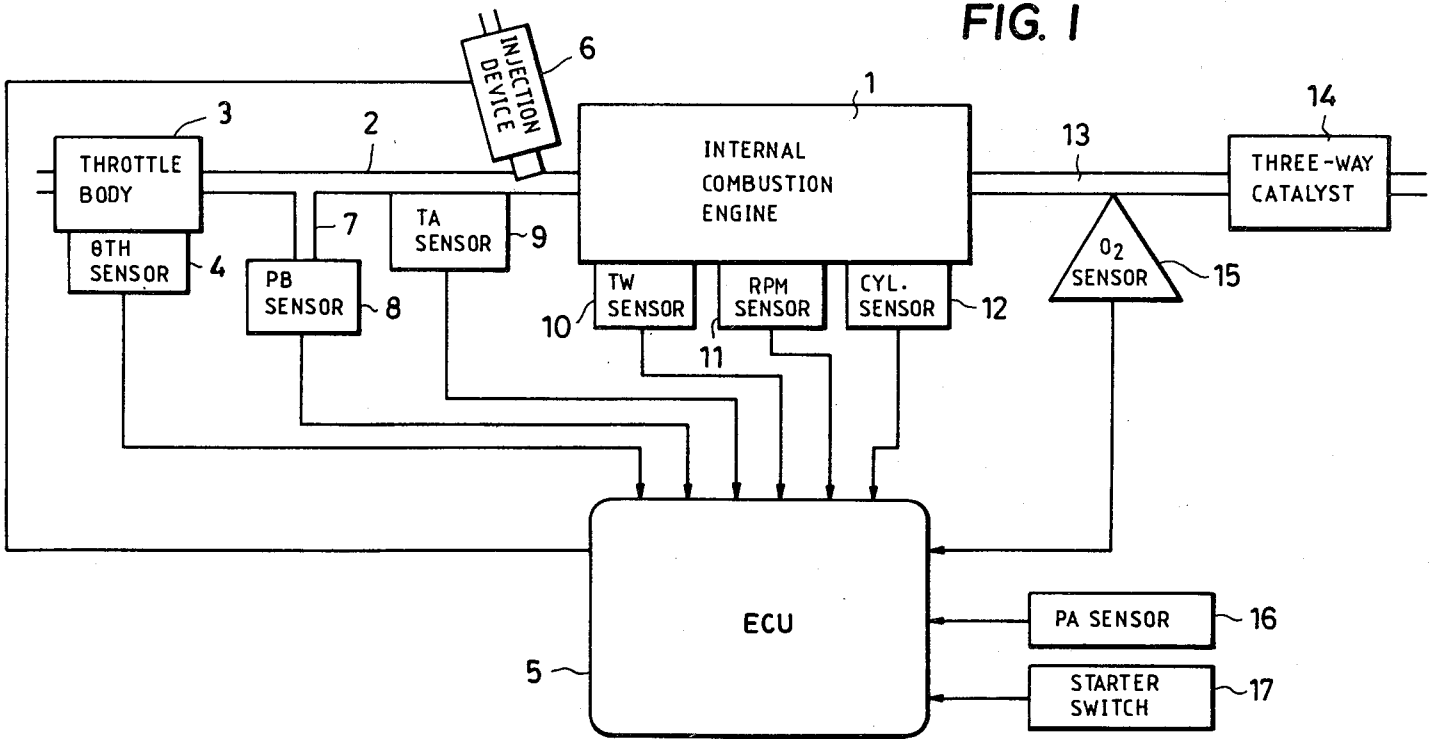
FIG. 1 is a block diagram illustrating the whole arrangement of a fuel supply control system to which is applicable the method according to this invention.

Referring first to FIG. 1, there is illustrated the whole arrangement of a fuel supply control system for internal combustion engines, to which the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjector are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying thereto an electrical signal indicative of detected intake-air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the starter, not shown, of the engine 1, respectively, for supplying an electrical signal indicative of detected atmospheric pressure and an electrical signal indicative of its own on and off positions to the ECU 5.

Next, the fuel quantity control operation of the air/fuel ratio feedback control system of the invention arranged as above will now be described in detail with reference to FIG. 1 referred to hereinabove and FIGS. 2 through 12.

Figure 2:
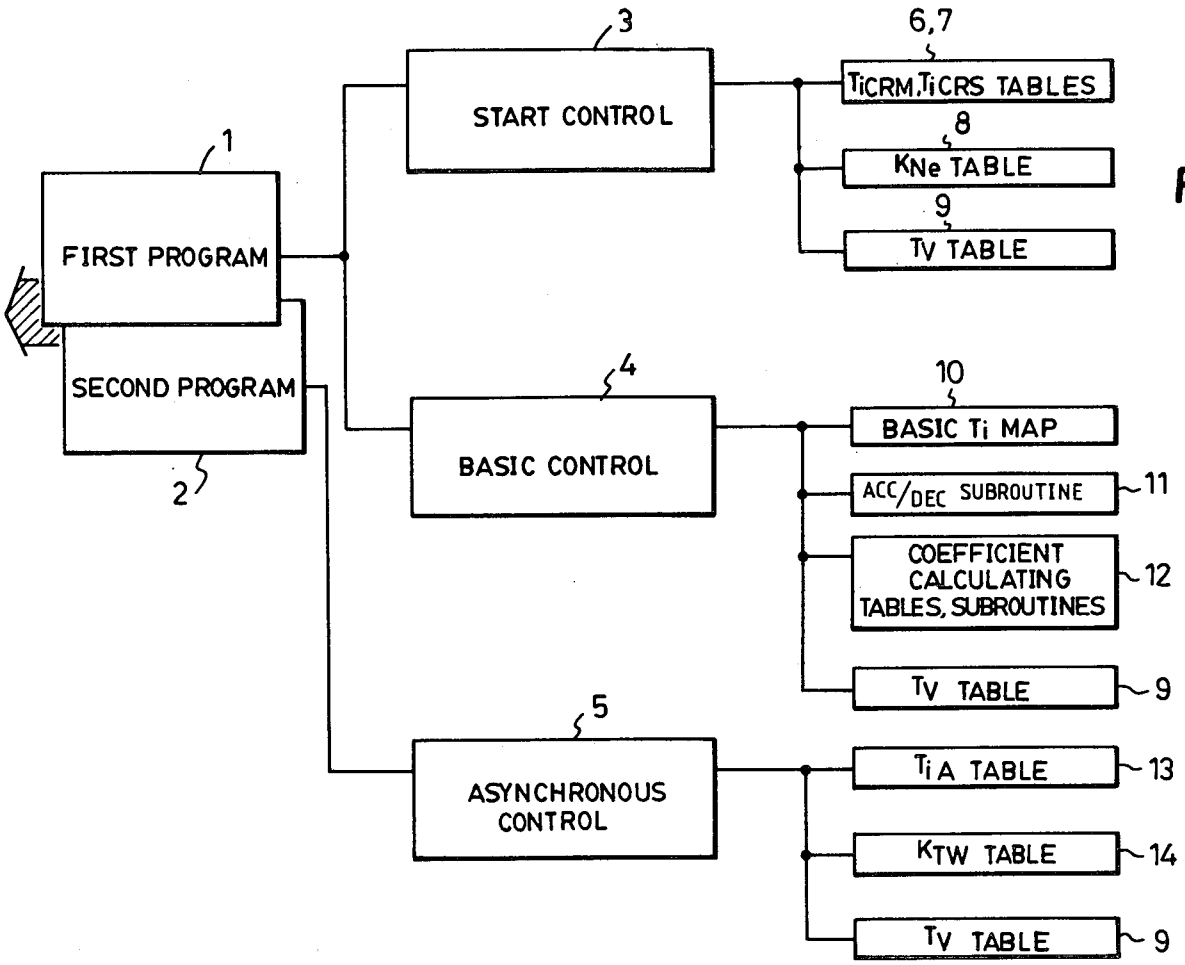
FIG. 2 is a block diagram illustrating a program for control of the valve opening periods TOUTM, TOUTS of the main injectors and the subinjector, which are operated by an electronic control unit (ECU) shown in FIG. 1.

Referring first to FIG. 2, there is illustrated a block diagram showing the whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \alpha TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. TV is added to TV applicable to the main injectors as distinct from TV applicable to the subinjector, because the main injectors are structurally different from the subinjector and therefore have different operating characteristics.

The basic equations for determining the vlues of TOUTM and TOUTS applicable to the basic control subroutine 4 are as follows:

$$TOUTM = TiM \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = TiS \times (KTA \times KTW \times KAST \times KPA) + TV \quad (4)$$

where TiM, TiS represents basic values of the valve opening periods for the main injectors and the subinjector, respectively, and are determined from a basic Ti map 10, and TACC represents a constant applicable at engine acceleration and is determined by the acceleration subroutines 11. The coefficients KTA, KTW, etc. are determined by their respective tables and/or subroutines 12. KTA is an intake air temperature-dependent correction coefficient and is determined from a table as a function of actual intake air temperature, KTW as fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient application at "lean stoich." operation and having a constant value. The term "stoich." is an abbreviation of a word "stoichiometric" and means a stoichiometric or theoretical air/fuel ratio of the mixture. The deceleration fuel cut subroutine 15 which is applicable to this invention sets to zero the respective values of TOUTM and TOUTS so as to interrupt the fuel supply to the engine when predetermined engine operating conditions are satisfied, in a manner hereinafter explained.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
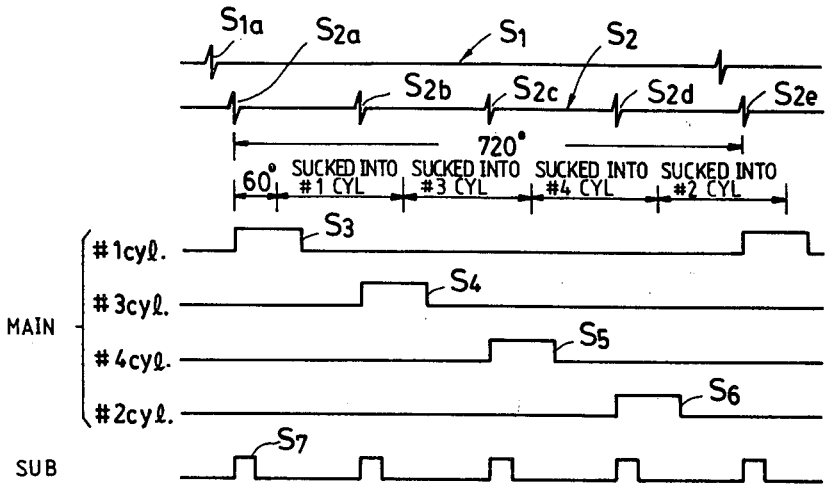
FIG. 3 is a timing chart showing the relationship between a cylinder-discriminating signal and a TDC signal, both inputted to the ECU, and drive signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2A$, the driving signal $S_4$ for the third engine cylinder concurrently with the second TDC signal pulse $S_2b$, the driving signal $S_5$ for the fourth cylinder concurrently with the third pulse $S_2C$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
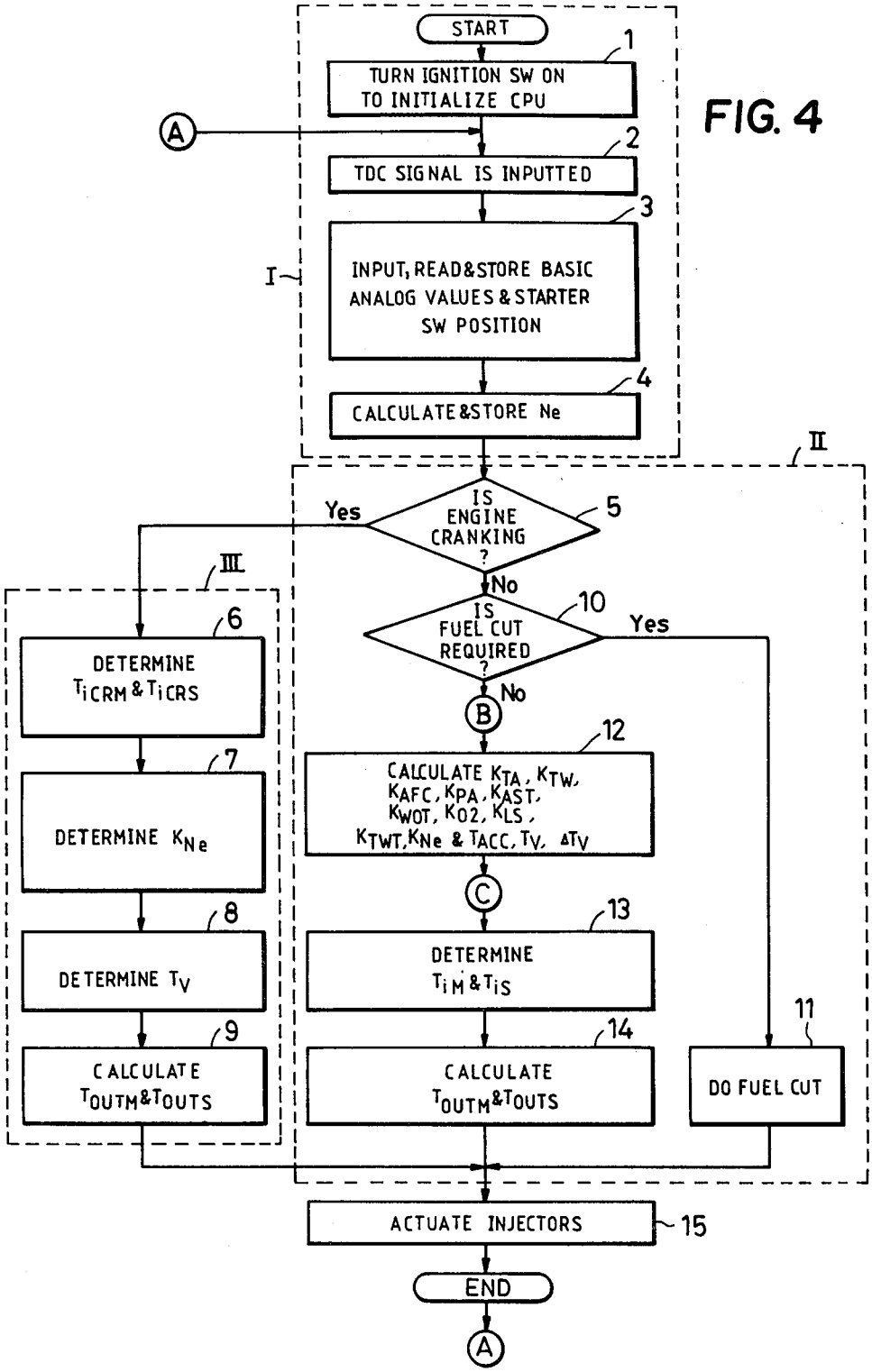
FIG. 4 is a flow chart showing a main program for control of the basic value opening periods TOUTM, TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, intake air temperature TA, throttle valve opening $\theta$TH, battery voltage V, output voltage value $V_{02}$ of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TACC, TV and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction constants selected at the steps 12 and 13, as described above, using the aforementioned equations (3), (4) (step 14). The main injectors and the subinjector are actuated with valve opening periods corresponding to the values of TOUTM, TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Next, the acceleration fuel increment constant TACC calculating subroutine and the deceleration fuel cut subroutine will be explained in respect of aforesaid controls of valve opening periods.

Figure 5:
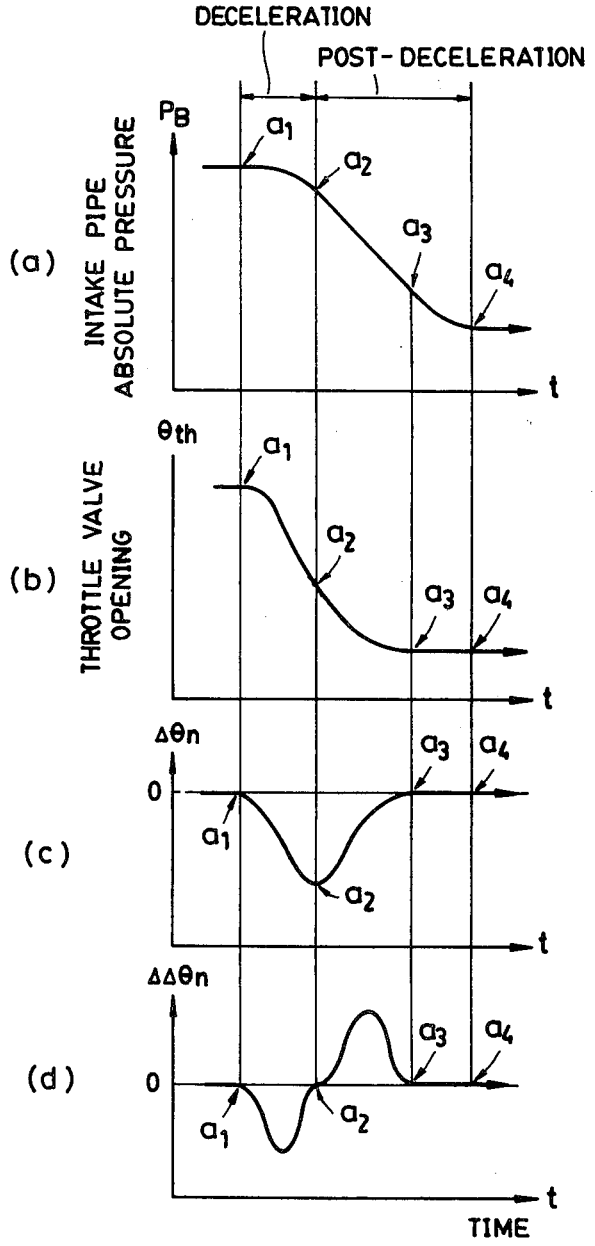
FIG. 5 is a timing chart showing the time lag in changes in absolute pressure in the intake passage in relation to throttle valve opening variation, while the throttle valve is being closed.

As previously explained, FIG. 5 is a timing chart showing the time lag in changes in intake passage absolute pressure PB in relation to changes in the throttle valve opening $\theta$TH, while the throttle valve is being closed at engine deceleration. When the throttle valve is abruptly closed, reduction in intake passage absolute pressure PB cannot immediately follow such a sudden change in the throttle valve opening $\theta$TH, as shown in (a) and (b) in FIG. 5. That is, there occurs a time lag in the decrease in intake passage absolute pressure PB with respect to changes in the throttle valve opening value $\theta$TH, and the intake passage absolute pressure PB continues to drop even after the throttle valve closing action has been finished, which lasts between the points $a_1$ and $a_3$ in (b) of FIG. 5, and becomes stable upon reaching the point $a_4$ in (a) of FIG. 5. On such occasions, it is advisable to interrupt the fuel supply to the engine in order to improve the emission characteristics and fuel consumption of the engine. However, if the fuel cut condition is set in response to changes in the throttle valve opening $\theta$TH ($\Delta\theta$n in (c) of FIG. 5), such fuel cut is terminated before the intake passage absolute pressure drops to a sufficiently low level, and the fuel cut is not carried out during the period of time from point $a_3$ to point $a_4$ in (a) of FIG. 5, as explained previously.

FIG. 6 shows a flow chart of a subroutine for calculating the fuel increment constants TACC and TPACC, respectively, at TDC signal-synchronous acceleration and post-acceleration and that of a fuel cut subroutine at TDC signal-synchronous engine deceleration.

First, the value $\theta$n of the throttle valve opening is read into a memory in ECU 9 upon application of each TDC signal pulse to ECU 9 (step 1). Then, the value $\theta n-1$ of the throttle valve opening in the previous loop is read from the memory at the step 2, to determine whether or not the difference $\Delta\theta$n between the value $\theta$n and the value $\theta n-1$ is larger than a predetermined synchronous acceleration control determining value G+, at the step 3. If the answer is yes at the step 3, the number of pulses NDEC stored in a deceleration ignoring counter, hereinafter referred to, is resetted to a predetermined number of pulses NDEC0 at the step 4. A further determination is made as to whether the difference $\Delta\Delta\theta$n between the difference $\Delta\theta$n in the present loop and the difference $\Delta\theta n-1$ in the previous loop is equal to or larger than zero, at the step 5. If the answer is yes, the engine is determined to be accelerating, and if the answer is no, it is determined to be in a post-acceleration state. The above differential value $\Delta\Delta\theta$n is equivalent to a value obtained by twice differentiating the throttle valve opening value $\theta$n. Whether the engine is accelerating or after acceleration is determined with reference to the point of contraflexure of the twice differentiated value curve and in dependence upon the direction of change of the throttle valve opening. When it is determined at the step 5 that the engine is accelerating, the number of post-acceleration fuel increasing pulses N2 corresponding to the variation $\Delta\theta n$ is set into a post-acceleration counter as a count NPACC (step 6). FIG. 7 and FIG. 8 show tables showing, respectively, the relationship between the variation $\Delta\theta n$ of the throttle valve opening and the acceleration fuel increasing constant TACC, and the relationship between the count NPACC and the post-acceleration fuel increasing constant TPACC. By referring to FIG. 7, a value TACCn of acceleration fuel increasing constant TACC is determined which corresponds to a variation $\Delta\theta n$. Then, by referring to FIG. 8, a value TPACCn of post-acceleration fuel increasing constant TPACC is determined which corresponds to the value TACCn determined above, followed by determining the value of post-acceleration fuel increasing pulses n2 from the value TPACCn determined. That is, the larger the throttle valve opening variation $\Delta\theta n$, the larger the post-acceleration fuel increment is. Further, the larger the variation $\Delta\theta n$, the larger value the post-acceleration count NPACC is set to, so as to obtain a longer fuel increasing period of time.

Simultaneously with the above step 6, the value of acceleration fuel increasing constant TACC is determined from the table of FIG. 7, which corresponds to the throttle valve opening variation $\Delta\theta n$ (step 7). The TACC value thus determined is set into the aforementioned equation (3), at the step 8.

On the other hand, if the aforementioned $\Delta\Delta\theta n$ is found to be smaller than zero as a result of the determination of the step 5, it is determined whether or not the post-acceleration count NPACC is larger than zero, which was set at the step 6 (step 9). If the answer is affirmative, 1 is subtracted from the same count NPACC at the step 10, to calculate a post-acceleration fuel increment value TPACC from the table of FIG. 8, which corresponds to the value NPACC-1 obtained above, at the step 11. The calculated value TPACC is set into the equation (3) as TACC value, at the step 8. When the post-acceleration count NPACC is found to be less than zero at the step 9, the value of TACC is set to zero at the step 13.

When the variation $\Delta\theta n$ is found to be smaller than the predetermined value G+ as a result of the determination of the step 3, it is determined whether or not the same value $\Delta\theta n$ is smaller than a predetermined synchronous deceleration determining value G−, at the step 14. If the answer is no, the computer judges that the engine is then cruising to have its program proceed to the step 9'.

At the step 9', it is determined whether or not the post-acceleration count NPACC is larger than 0, in the same way as in the step 9. If the answer to the above question is yes, the program proceeds to the aforementioned step 10. On the other hand, if the answer to the question in the step 9' is no, it is determined whether or not a post-deceleration count NPDEC, hereinafter referred to, is larger than 0 (step 12). If the answer is no, the program proceeds to the step 13 to set the value of the constant TACC to zero. If the answer to the question in the aforesaid step 14 is yes, it is determined at the step 15 whether or not the difference $\Delta\Delta\theta n$ between the throttle valve variation $\Delta\theta n$ and the throttle valve variation $\Delta\theta n-1$ of the last loop is either 0 or of a negative value. If the answer to the above question is in the affirmative, it is judged that the engine is decelerating, and if the answer is no, it is judged that the engine is operating in post-deceleration condition. That is, the engine operating condition during the time from $a_1$ to $a_2$ in (d) of FIG. 5 represents engine decelerating condition when the above difference $\Delta\Delta\theta n$ is negative and the engine operating condition after the point $a_2$ in (d) of FIG. 5 represents post-deceleration operating condition when the above difference $\Delta\Delta\theta n$ becomes positive. Then, if it is determined at the step 15 that the engine is operating in decelerating condition, the program proceeds to the step 16 wherein it is determined whether or not the engine is operating in deceleration ignoring condition. That is, according to this invention, even if the throttle valve opening variation $\Delta\theta n$ is smaller than the predetermined value G−, the engine is not judged to be decelerating (that is, the deceleration is ignored) until the number of TDC signal pulses counted by a deceleration ignoring counter exceeds a predetermined pulse number NDEC0.

This is to avoid that the fuel supply to the engine is stopped on a wrong judgement that the engine is decelerating, for instance, in the event that while the driver is accelerating the engine, he returns the accelerator pedal by a slight amount from its stepped position even for a very short time after having stepped on the accelerator pedal to accelerate the engine, causing a shortage in the fuel supply to the engine and thereby deteriorating the driveability of the engine. It is determined whether or not the pulse number NDEC in the deceleration ignoring counter, which has been reset to the initial value NDEC0 at the step 4, is larger than zero (that is, usually engine deceleration can be ignored when it occurs immediately after engine acceleration). If the pulse number NDEC is larger than zero, 1 is subtracted from the pulse number NDEC at the step 19 and the program moves to the aforementioned step 9'. If the pulse number NDEC thus reduced is found to be zero or less at the step 16, a post-deceleration fuel decreasing pulse number Nn corresponding to the aforementioned variation $\Delta\theta n$ is set as the post-deceleration count NPDEC (step 17).

FIG. 9 is a table showing the relationship between the throttle valve opening variation $\Delta\theta n$ and the post-deceleration count NPDEC. With reference FIG. 9, the larger the absolute value of the throttle valve opening variation $\Delta\theta n$ (a negative value), the larger value the post-deceleration count NPDEC is set to, so as to obtain a longer fuel cut period at post-deceleration, and on the other hand, the smaller the absolute value of the throttle valve opening variation $\Delta\theta n$ (a negative value), the smaller value the post-deceleration count NPDEC is set to. Next, the post-acceleration count NPACC is set to zero at the step 18, and the deceleration fuel cut is carried out at the step 21.

If it is determined in the step 15 that the engine is operating in post-deceleration condition (that is, $\Delta\Delta\theta n>0$, during engine operating condition between point $a_2$ and point $a_3$ in (d) of FIG. 5), the program proceeds to the step 12. When the post-acceleration count NPDEC is larger than 0, 1 is subtracted from the same count NPDEC at the step 20. Further, after making certain that the engine rpm Ne is higher than a predetermined rpm Nest (e.g. 1000 rpm) at which there is no fear of engine stall, even if fuel supply to the engine is interrupted in post-decelertion condition (that is, if the answer to the question in the step 22, whether or not the relationship Ne>Nest stands is yes), the program proceeds to the step 21 to execute the fuel cut. On the other hand, when it is determined at the step 22 that the engine rpm Ne is smaller than the predetermined rpm Nest (that is, the answer to the question at the step 22 is no), the fuel supply to the engine is not interrupted even if the engine is operating in post-deceleration condition warranting fuel cut (that is, the value of NPDEC is not yet 0).

Figure 10:
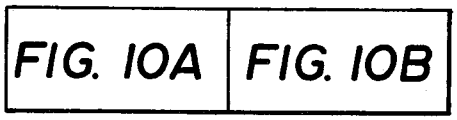
Figures 12, 12A, 12B:
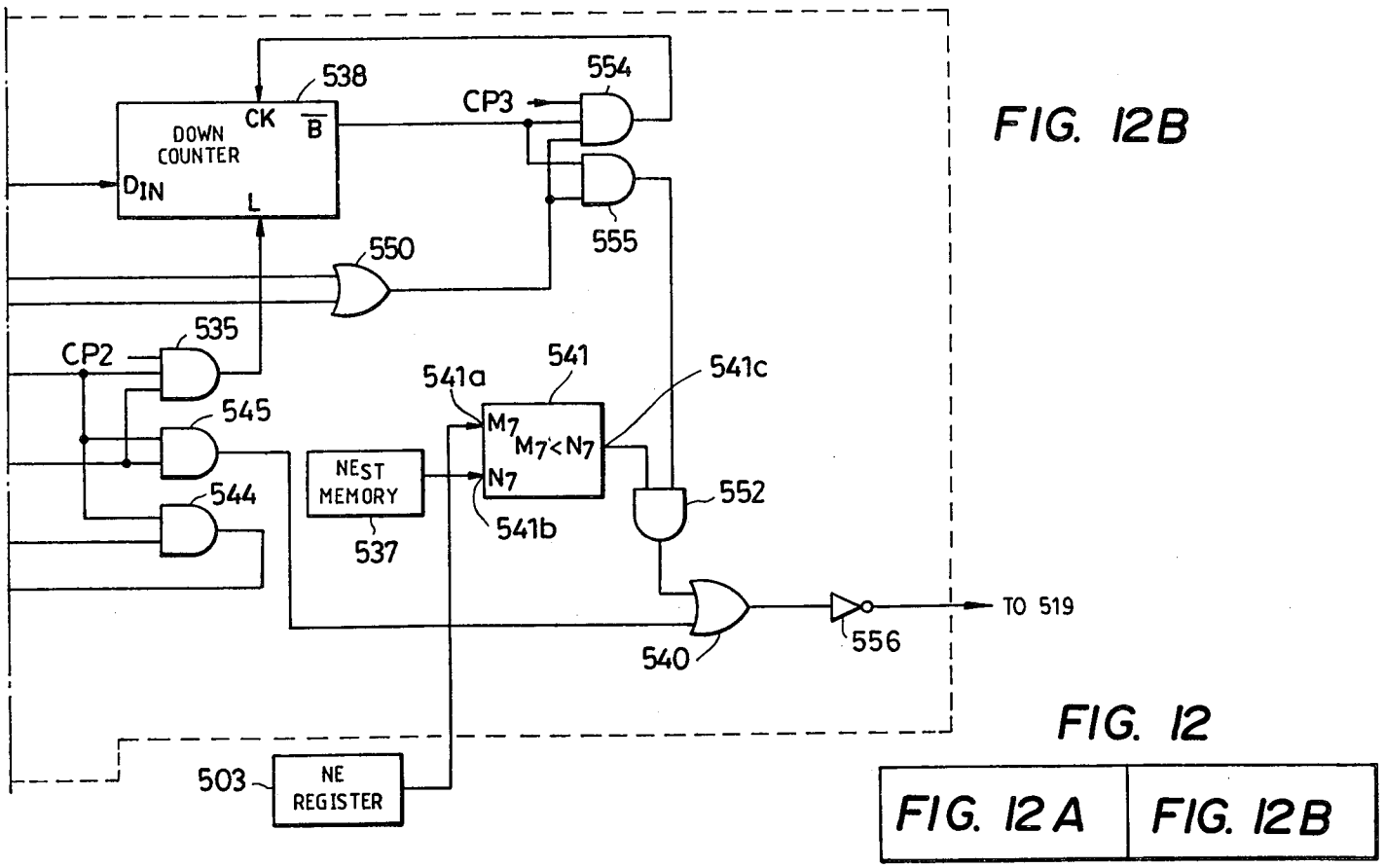
FIGS. 12A and 12B are a circuit diagram illustrating in detail the whole internal arrangement of a deceleration fuel cut determining circuit in FIG. 10.
Figure 12A:
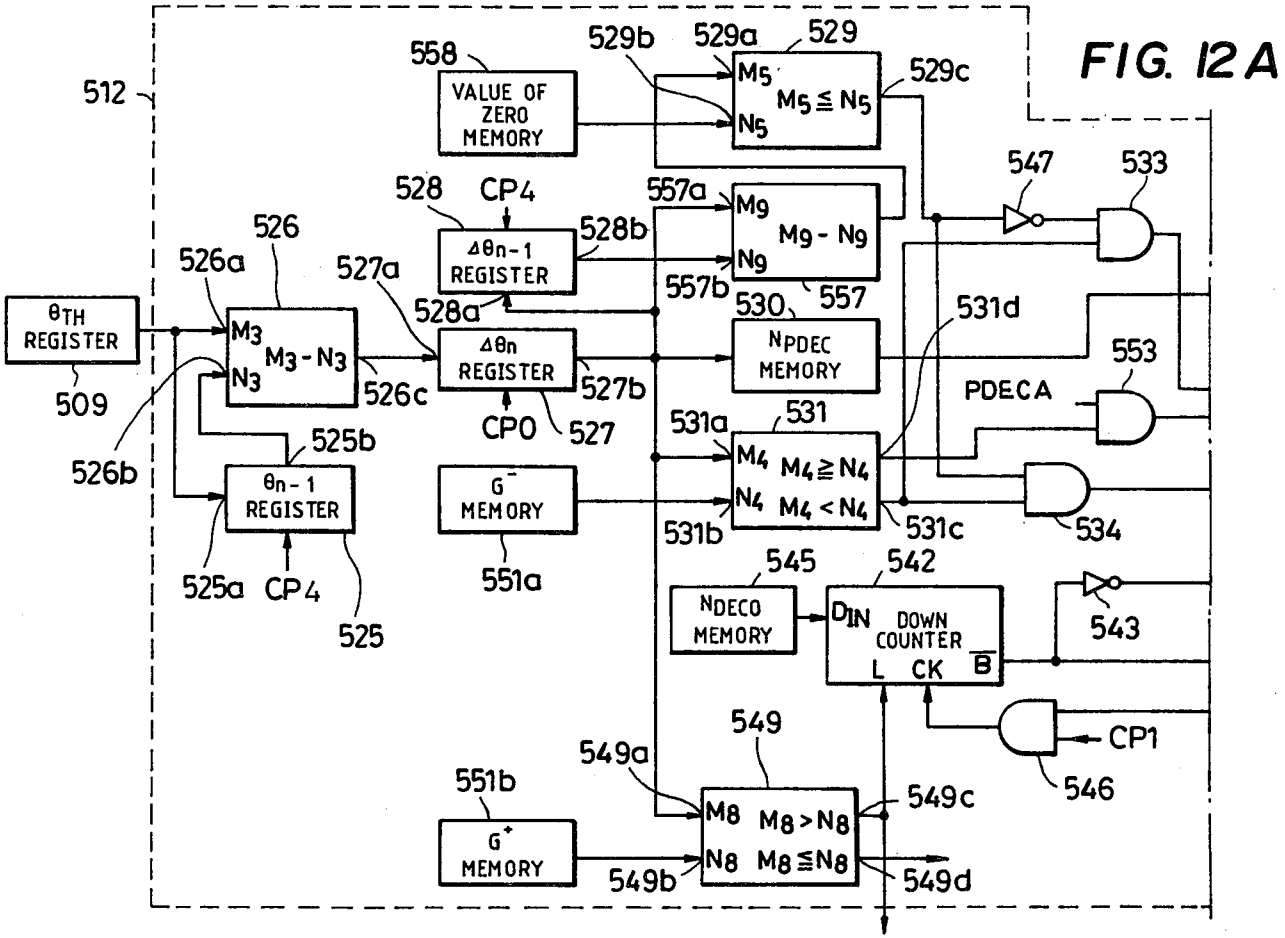

FIGS. 10 and 12 show the internal arrangement of the ECU 5 in FIG. 1, particularly showing in detail a section of deceleration fuel cut determination.

As illustrated in FIG. 10, showing the whole internal arrangement within the ECU 5, the intake passage absolute pressure (PB) sensor 8, the engine cooling water temperature (TW) sensor 10, the intake air temperature (TA) sensor 9, and the throttle valve opening ($\theta$TH) sensor 4, all appearing in FIG. 1, are respectively connected to the inputs of an absolute pressure (PB) value register 507, an engine cooling water temperature (TW) value register 508, an intake air temperature (TA) value register 506 and a throttle valve opening ($\theta$TH) value register 509 through an analog-to-digital converter unit 505. The outputs of the PB value register 507, the TW value register 508 and the TA value register 506 are connected to the inputs of a basic Ti value calculating circuit 510, and a coefficient calculating circuit 511, while the output of the $\theta$TH value register 509 is connected to the inputs of the coefficient calculating circuit 511, a deceleration fuel cut determining circuit 512 and an acceleration fuel supply increment calculating circuit 513. The engine rpm Ne sensor 11, shown in FIG. 1, is connected to the input of a sequential clock generator circuit 502 through an one shot circuit 501 which forms a waveform shaper, while the sequential clock generator circuit 502 has a group of output terminals connected to one input terminals of an engine rpm Ne counter 504, an engine rpm NE value register 503 and the deceleration fuel cut determining circuit 512. The input of the Ne counter 504 is connected to a reference clock generator 514, while its output is connected to the input of the NE value register 503. The output of the NE value register 503 is connected to the inputs of the basic Ti value calculating circuit 510, the coefficient calculating circuit 511 and the deceleration fuel cut determining circuit 512. The output of the basic Ti value calculating circuit 510 is connected to an input terminal 520*a* of multiplier 520, while another input terminal 520*b* of the multiplier 520 is connected to one output terminal of the coefficient calculating circuit 511. The multiplier 520 has its output terminal 520*c* connected to an input terminal 521*a* of an adder 521. A further multiplier 515 has its input terminals 515*a* and 515*b* connected to the other output terminal of the coefficient calculating circuit 511 and to the output of the acceleration increment calculating circuit 513, respectively, while having its output terminal 515*c* connected to the other input terminal 521*b* of the aforementioned adder 521. An output terminal 512*b* of the deceleration fuel cut determining circuit 512 is connected to the other input of the acceleration increment calculating circuit 513, while its other output terminal 512*a* is connected to one input terminal of an AND circuit 519. Connected to the other input terminal of the AND circuit 519 is an output 512*c* of the adder 521, while the output of the AND circuit 519 is connected to the fuel injection valve 6 shown in FIG. 2, through a TOUT value register 522 and a TOUT value control register 523.

Figure 11:
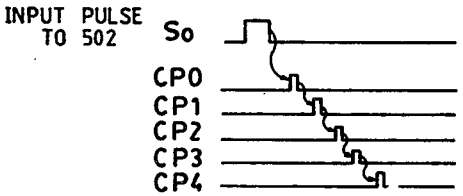
FIG. 11 is a timing chart illustrating the sequential order of clock pulses generated by the sequential clock generator.

Next, the operation of the circuit constructed as above will be explained. The TDC signal picked up by the engine rpm Ne sensor 11 appearing in FIG. 1 is applied to the one shot circuit 501 which forms a waveform shapes circuit in cooperation with the sequential clock generator circuit 502 arranged adjacent thereto. The one shot circuit 501 generates an output pulse So upon application of each TDC signal pulse thereto, which signal actuates the sequential clock generator circuit 502 to generate clock pulses CP0-4 in a sequential manner. FIG. 11 is a timing chart showing clock pulses generated by the sequential clock generator circuit 502, which is responsive to an output pulse So from the one shot circuit 501, inputted there to, to generate clock pulses CP0-4 in a sequential manner. The clock pulse CP0 is applied to the engine rpm NE register 503 to cause same to store an immediately preceding count supplied from the engine rpm (Ne) counter 504 which counts reference clock pulses generated by the reference clock generator 509. The clock pulse CP1 is applied to the engine rpm (Ne) counter 504 to reset the immediately preceding count in the counter 504 to zero. Therefore, the engine rpm Ne is measured in the form of the number of reference clock pulses counted between two adjacent pulses of the TDC signal, and the counted reference clock pulse number or measured engine rpm Ne is stored into the above engine rpm NE register 503. The clock pulses CP0-4 are supplied to the deceleration fuel cut determining circuit 512, hereinafter explained.

In a manner parallel with the above operation, output signals of the throttle valve opening ($\theta$TH) sensor 4, the intake air temperature TA sensor 9, the absolute pressure PB sensor 8 and the engine cooling water TW temperature sensor 10 are supplied to the A/D converter unit 505 to be converted into respective digital signals which are in turn applied to the throttle valve opening ($\downarrow$ TH) register 509, the intake air temperature (TA) register 506, the absolute pressure (PB) register 507 and the engine cooling water temperature (TW) register 508, respectively.

The basic Ti value calculating circuit 510 calculates the basic valve opening period for the main injectors on the basis of the output values supplied from the absolute pressure PB value register 507, the engine cooling water temperature TW value register 508, the intake air temperature TA value register 506, and the engine rpm Ne register 503 and applies this calculated Ti value as input $A_1$ to the input terminal 520*a* of the multiplier 520. The coefficient calculating circuit 511 calculates by the use of the equation (3) the values of coefficients KTA, KTW, etc. on the basis of stored values supplied thereto from the absolute pressure (PB) register 507, the engine cooling water temperature (TW) register 508, the intake air temperature (TA) register 506, the engine rpm NE register 503 and the throttle valve opening ($\theta$TH) register 509, and applies two calculated values indicative of products of coefficients, one as an input $B_1$ to the input terminal 520*b* of the multiplier 520 and the other as an input $A_2$ to the input terminal 515*a* of the multiplier 515, respectively. On the basis of the stored value $\theta$n from the throttle valve opening ($\theta$TH) value register 509 and an acceleration signal value indicative of the engine accelerating condition from the deceleration fuel cut determining circuit 512, the acceleration increment calculating circuit 513 calculates the acceleration fuel supply increment value TACC through the calculation steps previously explained with reference to FIG. 6, and applies this TACC value as an input $B_2$ to the input terminal 515*b* of the multiplier 515. The multiplier 515 multiplies the input values $A_2$ and $B_2$ inputted thereto, respectively, through its input terminals 515*a* and 515*b* and applies the resultant product value (that is, the TACC value corrected by intake air temperature correction coefficient KTA, atmospheric pressure correction coefficient KPA, etc. by means of in the equation (3)), as an input $N_1$ to the input terminal 521*b* of the adder 521. Further, when the engine is operating in an operating condition other than either acceleration or post-acceleration, the acceleration fuel supply increment value TACC from the TACC acceleration increment calculating circuit 513 is set to zero, causing the TACC value signal input $N_1$ supplied to the input terminal 521*b* of the adder 521 to become zero.

The multiplier 520 which has its input terminals 520*a* and 520*b* supplied with the basic Ti value from the basic Ti value calculating circuit 510 as an input signal $A_1$ and the coefficient product value from the coefficient calculating circuit 511 as an input signal $B_1$, respectively, multiplies these two values and applies the resultant product value ($A_1 \times B_1$) to the other input terminal 521*a* of the adder 521 as an input signal $M_1$. Next, the adder 521 adds up this product value $M_1$ and the acceleration fuel increment value corrected by the aforementioned correction coefficients and applied thereto to its input terminal 521*b* as an input signal $N_1$ and applies this resultant value ($M_1+N_1$), that is, the fuel injection valve opening period TOUT in the equation (3), to one input terminal of the AND circuit 519.

By the use of each stored value from the throttle valve opening $\theta$TH register 509, and engine rpm NE register 503 in addition to check pulses CP0 through CP4 from the sequential clock generator 502, the deceleration fuel cut determining circuit 512 executes the steps shown in FIG. 6, in a manner hereinafter explained and generates an output signal having a low level of 0 when a deceleration fuel cut condition stands, and applies this low level signal to the AND circuit 519 to deenergize same. This is, the fuel injection valve opening period TOUT value supplied to one input terminal of the AND circuit 519 is prevented from passing on to the TOUT value register 522, thereby interrupting the fuel supply to the engine. On the other hand, when deceleration fuel cut conditions do not stand, the deceleration fuel cut determining circuit 512 generates an output having a high level of 1 and applies it to the AND circuit 519 to maintain same in an energized state.

Responsive to the TOUT value inputted from the TOUT value register 522, the TOUT value control circuit 523 supplies a control signal to the fuel injection valve(s) 6 to drive same.

FIG. 12 is a circuit diagram showing in detail the internal arrangement within the deceleration fuel cut determining circuit 512 in FIG. 10.

The throttle valve opening ($\theta$TH) register 509, appearing in FIG. 10, is connected to input terminals 526*a* and 525*a*, respectively, of a subtractor 526 and a $\theta n-1$ value register 525. Connected to an input terminal 526*b* of the above subtracter 526 is an output terminal 525*b* of the above $\theta n-1$ value register 525, while its output terminal 526*c* is connected to an input terminal 527*a* of a $\Delta\theta n$ value register 527. The $\Delta\theta n$ register 527 has its output terminal 527*b* connected to the input of a post-deceleration count NPDEC value memory 530, as well as to input terminals 557*a*, 531*a*, 549*a* and 528*a*, respectively, of a subtracter 528, comparators 531, 549 and a $\Delta\theta n-1$ register 528. The subtracter 557 has another input terminal 557*b* connected to an output terminal 528*b* of the above $\Delta\theta n-1$ register 528, while its output terminal 557*c* is connected to one input terminal 529*a* of a comparator 529. Also, the other input terminal 529*b* of the comparator 529 is connected to a 0 value memory 558, while its output terminal 529*c* is conncted to one input terminal of an AND circuit 534 directly, as well as to one input of an AND circuit 533 through an inverter 547. The comparator 531 has the other input terminal 531*b* connected to a $G^-$ value memory 551*a* while its output terminal 531*c* is connected to the other input terminals of the AND circuits 533 and 534, and its output terminal 531*d* one input terminal of an AND circuit 553, respectively. The comparator 549 has the other input terminal 549*b* connected to a $G^+$ value memory 551*b* while its output terminal 549*c* is connected to a data loading terminal L of a down counter 542, as well as to the acceleration increment value calculating circuit 513, appearing in FIG. 10. The comparator 549 has its output terminal 549*d* connected to the other input terminal of the AND circuit 553. The outputs of the AND circuits 533 and 553 are connected to the inputs of an OR circuit 550. The output of the AND circuit 534 is connected to one input terminals of AND circuits 535, 544 and 545.

The aforesaid down counter 542 has a data input terminal DIN connected to the output of an NDEC0 value memory 545, while its borrow output terminal $\overline{B}$ is connected to the input of the AND circuit 544, as well as to the inputs of AND circuits 535 and 545 through an inverter 543. The output of the AND circuit 544 is connected to one input terminal of an AND circuit 546 which in turn has its output connected to a clock input terminal CK of the above down counter 542.

The output of the aforesaid NPDEC value memory 530 is connected to the data input terminal DIN of a down counter 538 which has its data loading terminal L connected to the output of the aforesaid AND circuit 535, while its borrow output terminal $\overline{B}$ to the inputs of AND circuits 554 and 555, respectively. The output of the aforesaid OR circuit 550 is connected to inputs of the AND circuits 554 and 555 which in turn has its outputs connected, respectively, to the clock input terminal CK of the down counter 538 and one input terminal of an AND circuit 552.

The NE value register 503, appearing in FIG. 10, is connected to an input terminal 541*a* of a comparator 541, while an NEST value memory 537 is connected to the other input terminal 541*b* of the same comparator. The comparator 541 has its output terminal 541*c* connected to the other input terminal of the AND circuit 552. An OR circuit 540 has two input terminals connected, respectively, to the outputs of the AND circuits 545 and 552, while its output is connected to one input terminal of an AND circuit 519, shown in FIG. 10, through an inverter 556.

The aforesaid $\theta n-1$ value register 525, $\Delta\theta n$ value register 527, and $\Delta\theta n--1$ value register 528 and also AND circuits 535, 546 and 554 have their inputs connected to the group of output terminals of the sequential clock generator 502 appearing in FIG. 10.

The operation of the circuit constructed as above will now be explained.

The $\theta$TH value register 509, appearing in FIG. 10, generates a signal indicative of the throttle valve opening value $\theta n$ and applies it as an input $M_3$ to the input terminal 526*a* of the subtracter 526 (step 1 in FIG. 6).

On the other hand, the $\theta n-1$ value register 525 stores a signal indicative of the throttle valve opening value $\theta n-1$ inputted thereto at the instant of application of a clock pulse CP4 thereto in the last loop, and this stored signal value is supplied as an input $N_3$ to the other input terminal 526*b* of the subtractor 526 (step 2 in FIG. 6). The subtracter 526 subtracts the input value $N_3$ from the input value $M_3$ and supplies for storing the resultant value ($M_3$-$N_3$), that is, the value $\Delta\theta n(=\theta n-\theta n-1)$ to the $\Delta\theta n$ value register 527 at the instant of application of a clock pulse CP0 thereto.

At the same time, the NPDEC value memory 530 which stores a plurality of predetermined post-deceleration count values corresponding to the throttle valve opening value variations $\Delta\theta n$, shown in FIG. 9, reads out a value Nn of the NPDEC values so stored corresponding to the above $\Delta\theta n$ value supplied from the aforementioned $\Delta\theta n$ value register 527 and supplies the same to the data input terminal DIN of the down counter 538, in a manner hereinafter explained. Further, the abovementioned NPDEC value memory 530 may be either matrix memory which reads out a value from among a plurality of predetermined NPDEC values corresponding to the throttle valve opening value variations $\Delta\theta n$ in the aforesaid manner, or calculating circuit which calculates a NPDEC value corresponding to the throttle valve opening value variation $\Delta\theta n$, by the use of predetermined arithmetic equation.

The predetermined synchronous acceleration determining value $G^+$ for the throttle valve opening value, already explained at step 3 in FIG. 6, is stored in the $G^+$ value memory 551*b* and is applied as an input $N_8$ to the input terminal 549*b* of the comparator 549. The comparator 549, which also has its input terminal 549*a* supplied with a throttle valve opening value variation $\Delta\theta n$ signal as an input $M_8$ from the $\Delta\theta n$ value register 527, compares this value $M_8$ with the input value $N_8$ or the value $G^+$ referred to hereabove (step 3 in FIG. 6). When the relationship $\Delta\theta n>G^+(M_8>N_8)$ stands, that is, the engine is determined to be accelerating, the comparator 549 generates a signal having a high level of 1 through its output terminal 549*c* and applies it as an acceleration signal ACC to the acceleration fuel supply increment value determining circuit 513, in FIG. 11 and at the same time, the same comparator applies the same high level output to the data loading terminal L of the down counter 542, on the other hand, if the comparator 549 determines that the relationship $\Delta\theta n\leqq G^+(M_8\leqq N_8)$ stands, the same comparator now generates a signal having a high level of 1 (PDECA signal) through its other output terminal 549*d* and applies it as a signal PDECA to the AND circuit 553.

A predetermined initial value NDEC0 of the deceleration ignoring count NDEC, shown at the step 4 in FIG. 6, is stored in the NDEC0 value memory 545 and this stored value is applied to the data input terminal DIN of the down counter 542. As long as the down counter 542 has its data loading terminal L supplied with the above-mentioned high level signal from the comparator 549, the down counter 542 maintains the output of its borrow terminal $\overline{B}$ at a high level of 1 without starting counting even if clock pulses are applied to its clock input terminal CK, as the down counter is kept in a state of constantly updating its data, by the above high level signal. When the output from the comparator 549 is inverted into a low level of 0, that is, when the value $\Delta\theta n$ becomes smaller than or equal to the predetermined value $G^+$, the down counter 542 starts counting by subtracting 1 from the initial value NDEC0 of the deceleration ignoring count NDEC upon application of each clock pulse CP1 to its clock input terminal CK, as the down counter 542 can no longer update its data. Until the deceleration ignoring count NDEC is reduced to 0, the down counter 542 continuously generates an output signal having a high level of 1 through its borrow output terminal $\overline{B}$ and applies it to the AND circuit 544 and the inverter 543.

In the $G^-$ value memory 551*a* is stored the predetermined synchronous deceleration determining value $G^-$ for the throttle valve opening value, which is supplied as an input $N_4$ to the input terminal 531*b* of the comparator 531. The comparator 531 compares this $G^-$ value with a throttle valve opening variation value $\Delta\theta n$ supplied to its input terminal 531*a* as an input $M_4$ from the $\Delta\theta n$ value register 527 (step 14 in FIG. 6). When the relationship $\Delta\theta n<G^-(M_4<N_4)$ stands, that is, when the engine is determined to be operating in decelerating condition, the comparator 531 generates a signal having a high level of 1 through its output terminal 531*c* and applies it to the AND circuits 533 and 534. On the other hand, if the value $\Delta\theta n$ is higher than or equal to the predetermined value $G^-(M_4\geqq N_4)$, the same comparator generates a signal having a high level of 1 through its other output terminal 531*d* and applies it to the AND circuit 553.

The subtractor 557 also has its input terminal 557*a* supplied with the throttle valve opening variation value $\Delta\theta n$ from the $\Delta\theta n$ value register 527 as an input $M_9$ while at the same time the same subtracter has its other input terminal 557*b* supplied with a throttle valve opening variation value $\Delta\theta n-1$ of the last loop as an input $N_9$ from the $\Delta\theta n-1$ value register 528. This throttle valve opening variation $\Delta\theta n-1$ has been supplied from the $\Delta\theta n$ value register 527 to the $\Delta\theta n-1$ value register 528 in the last loop upon application of a clock pulse CP4 thereto and stored therein. The subtracter 557 determines the difference between the variation value $\Delta\theta n$ of this loop and the variation value $\Delta\theta n-1$ of the last loop and supplies the determined difference $\Delta\Delta\theta n$ to the comparator 529. The comparator 529 has its other input terminal 529*b* supplied with a 0 value signal $N_5$ from the 0 value memory 558. The comparator 529 compares the above difference $\Delta\Delta\theta n$ with the value of the 0 value signal (step 15 in FIG. 6), and when the difference $\Delta\Delta\theta n$ is smaller than or equal to zero. (that is, $M_5\leqq N_5$, $\Delta\Delta\theta n=\Delta\theta n-\ \Delta\theta n-1\leqq 0$), the comparator 529 generates a signal having a high level of 1 through its output terminal 529*c* and applies it to the other input terminal of the AND circuit 534.

When the AND circuit 534 is supplied with the above signals having a high level of 1 at its both input terminals, that is, when the throttle valve opening variation value $\Delta\theta n$ is smaller than the above predetermined value $G^-(\Delta\theta n<G^-)$, and at the same time, the above difference $\Delta\Delta\theta n$ is either a negative entity or equal to zero ($\Delta\Delta\theta n\leqq 0$), it generates a high level signal of 1 and applies it to the AND circuits 535, 544 and 545. When the AND circuit 544 has its input terminals both supplied with the high level signals of 1, that is, when the relationships $\Delta\theta n<G^-$, $\Delta\Delta\theta n\leqq 0$ both stand and simultaneously the deceleration ignoring count NDEC is not zero, the AND circuit 544 generates a high level signal of 1 and applies it to the AND circuit 546 to energize same. The energized AND circuit 546 allows clock pulses CP1 to pass therethrough to the clock input terminal CK of the down counter 542 in synchronism with the TDC signal.

While the output at the borrow output terminal $\overline{B}$ of the down counter 542 remains at a high level of 1, the inverter 543 supplies the inputs of the AND circuits 535 and 545 with a low level signal of 0 to deenergize these circuits. When the output of the down counter goes low, that is, when the predetermined count NDEC0 is counted down to zero at the down counter 542, the inverter 543 supplies an inverted output signal having a high level of 1 to the AND circuits 535 and 545.

If the AND circuit 545 has its two input terminals both supplied with the high level signals of 1, that is, if the relationships $\Delta\theta n < G^-$ and $\Delta\Delta\theta n \leqq 0$ both stand, and at the same time, if the deceleration ignoring count is zero, the AND circuit 545 generates an output having a high level of 1 and applies it to the inverter 556 through the OR circuit 540. The inverter 556 inverts this output signal having a high level of 1 into a signal having a low level of 0 and applies it to the AND circuit 519, in FIG. 10, to deenergize same (step 21 in FIG. 6).

On the other hand, if the AND circuit 535 has its two input terminals supplied with high level signals of 1 so as to be energized, it allows clock pulses CP2, supplied to the remaining input terminals, to be applied to the data loading terminal L of the down counter 538 to cause loading of the aforesaid called out or read Nn value from the NPDEC value memory into the down counter 538 through the data input terminal DIN (step 17 in FIG. 6). While the AND circuit 535 remains energized, that is, as long as the both relationships $\Delta\theta n < G^-$ and $\Delta\Delta\theta n \leqq 0$ stand, and at the same time, the deceleration ignoring count NDEC is zero, the above inputting of data into the counter 538 continues in synchronism with the TDC signal to update the data in the data counter 538 by setting the initial value Nn as the post-deceleration count NPDEC.

Further, when the throttle valve opening value variation $\Delta\theta n$ of the present loop is larger than the variation $\Delta\theta n-1$ of the previous loop, (that is, $M_5 > N_5$, $\Delta\Delta\theta n = \Delta\theta n - \Delta\theta n - 1 > 0$), the output of the comparator 529 becomes a low level of 0 which not only deenergizes the AND circuit 534 but also gets inverted into a signal having a high level of 1 at the inverter 547, and the inverted high level of 1 is applied to the AND circuit 533. When the AND circuit 533 has its input terminals both supplied with the signals having a high level of 1, that is, when the relationships $\Delta\theta n < G^-$ and $\Delta\Delta\theta n < 0$ stand, the AND circuits 533 generates a signal having a high level of 1 and applies it to the input terminals of AND circuits 554 and 555 through the OR circuit 550. While the deceleration count NDEC is not zero, these AND circuits 554 and 555 have their other input terminals supplied with a signal having a high level of 1 from the down counter 538 through its borrow terminal $\overline{B}$. Thus, the AND circuits 554 and 555 have their respective two terminals supplied with signals having a high level of 1, and energized, thereby allowing clock pulses CP3 to be supplied to the clock input terminal CK of the down counter 538 through the energized AND circuit 554. The down counter 538 subtracts 1 each from its count with the application of every clock pulse CP3. The down counter 538 continues counting until the post-deceleration count NPDECn becomes zero, during which time it maintains the output from its borrow output terminal $\overline{B}$ at a high level of 1.

On the other hand, when the aforementioned signals having a high level of 1 are applied to two input terminals of the AND circuit 555, the AND circuit 555 generates an output of 1 and applies it to one input terminal of the AND circuit 552.

Next, when the relationship $\Delta\theta n \leqq G^-$ (that is, $M_4 \leqq N_4$) stands, the comparator 531 now generates an output signal having a low level of 1 to a signal through its output terminal 531C, which deenergizes the AND circuit 533, thereby suspending the passing of a high level signal from the AND circuit 533 to the AND circuits 554 and 555 through the OR circuit 550. On this occasion, if signals having high level of 1 are supplied to the AND circuit 553 at its both input terminals, that is, when the relationships $\Delta\theta n \leqq G^-(M_4 \leqq N_4)$ at the comparator 531 and $\Delta\theta n \leqq G^+ (M_8 \leqq N_8)$ at the comparator 549 both stand, the output from the AND circuit 553 becomes a high level of 1 which is in turn applied to the AND circuits 554 and 555 through the OR circuit 550 to continue to maintain both these circuits in energized state. In this way, the AND circuit 554 continues to allow the supply of clock pulses CP3 to the down counter 538 to continue counting by same. When the post-deceleration count NPDECn becomes zero, the high level output from the borrow output terminal $\overline{B}$ of the down counter 538 is inverted into a low level of 0 which is then supplied to the AND circuits 554 and 555 to deenergize same.

In the NEST value memory 537, a reciprocal value of a predetermined rpm Nest (for example, 1000 rpm), shown in step 22 in FIG. 6, is stored, which is supplied to the input terminal **541*b* of the comparator 541 as an input $N_7$, while a reciprocal value of the actual engine rpm Ne from the NE value register 503 in FIG. 11 is being supplied to its other input terminal 541*a* as an input $M_7$. The comparator 541 determines whether or not the actual engine rpm Ne is higher than the predetermined rpm Nest (step 22, in FIG. 6). When the relationship Ne>Nest, that is, $(M_7 < N_7)$ stands, the comparator 541 generates a high level output of 1 through its output terminal 541*c* and applies it to the AND circuit 552 to energize same, and when the relationship Ne≦Nest (that is, $M_7 \geqq N_7$) stands, the comparator 541 generates a low level output of 0 and applies it to the AND circuit 552** to deenergize same.

When the AND circuit 552 is supplied with signals having a high level of 1 from both the comparator 541 and the AND circuit 554 at the same time, it generates an output of 1 and applies it to the inverter 556 through the OR circuit 540 and the inverter in turn deenergizes the AND circuit 519 in FIG. 10, in the same way as explained before.

Although the illustrated example of FIG. 12 relies upon the application of clock pulses in synchronism with the TDC signal at the sequential clock generator circuit 502 in FIG. 10, such clock pulses may alternatively be from a sequence clock generator that does not synchronize its output signal with the TDC signal.

What is claimed is:

1. A method for controlling the quantity of fuel being supplied to an internal combustion engine having an intake passage and a throttle valve arranged therein, at deceleration thereof, by electronic means, the method comprising the steps of: (1) detecting the valve opening of said throttle valve while said throttle valve is being closed at deceleration of said engine and each time each pulse of a predetermined sampling signal is generated, (2) determining the difference between a value of the valve opening of said throttle valve detected at the time of generation of a present pulse of said sampling signal and one detected at the time of generation of the preceding pulse of said sampling signal and adapting the difference thus determined as a control parameter, (3) comparing the value of said control parameter with a predetermined negative value, (4) comparing the value of said control parameter at the present pulse of said sampling signal with the value of said control parameter at the preceding pulse of said sampling signal, and (5) interrupting fuel supply to said engine during either of the following periods of time, in dependence upon results of said comparison at the steps (3) and (4) thereof: (a) a period of time during which it is determined that the value of said control parameter determined at the time of generation of the present pulse of said sampling signal is smaller than said predetermined negative value, and at the same time it is smaller than the value of said control parameter at the preceding pulse of said sampling signal, and (b) a period of time starting from a time it is judged for the first time that the value of said control parameter at the present pulse of said sampling signal has exceeded the value of said control parameter at the preceding pulse of said sampling signal, while at the same time, the value of said control parameter at the present pulse of said sampling signal is smaller than the aforementioned predetermined negative value, until a first predetermined period of time elapses.

2. A method as claimed in claim 1, wherein, said first predetermined period of time has a value thereof set to a value corresponding to the value of said control parameter determined at the generation of a pulse of said sampling signal when it is determined for the first time that the value of said control parameter at the present pulse of said sampling signal has exceeded the value of said control parameter at the preceding pulse of said sampling signal.

3. A method as claimed in claim 1, wherein, the interruption of fuel supply to said engine is started after the lapse of a second predetermined period of time from a time it is determined for the first time that the value of said control parameter at the present pulse of said sampling signal has become smaller than said predetermined negative value.

4. A method as claimed in claim 3, wherein said second predetermined period of time has a value thereof set to a value corresponding to a period of time starting from a time it is determined for the first time that the value of said control parameter at the present pulse of said sampling signal is smaller than said predetermined negative value, until pulse of said sampling signal generated reach a predetermined number while at the same time it is continuously determined that the value of said control parameter at the present pulse of said sampling signal is smaller than said predetermined negative value.

* * * * *

UNITED STATES PATENT AND TRADEMARK OFFICE

CERTIFICATE OF CORRECTION

PATENT NO. : 4,459,962

DATED : July 17, 1984

INVENTOR(S) : Akihiro Yamato, Shigeo Umesaki

It is certified that error appears in the above-identified patent and that said Letters Patent is hereby corrected as shown below:

Figure 6B, should appear as shown on the attached sheet;

Column 10, line 6: insert "or 0" after "negative";

Column 10, line 60: change "post-acceleration" to "post-deceleration";

Column 13, line 67: change "subtracter 528" to "subtracter 557";

Column 17, line 26: change "terminals" to "terminal";

Column 17, line 53: change "deceleration count NDEC" to "post-deceleration count NPDEC";

Column 17, line 63: delete "each" before "from";

Column 18, line 8: delete "to a signal" before "through".

Signed and Sealed this

*Eighth* Day of *October 1985*

[SEAL]

*Attest:*

*Attesting Officer*

DONALD J. QUIGG

*Commissioner of Patents and Trademarks—Designate*

Figure 6A:
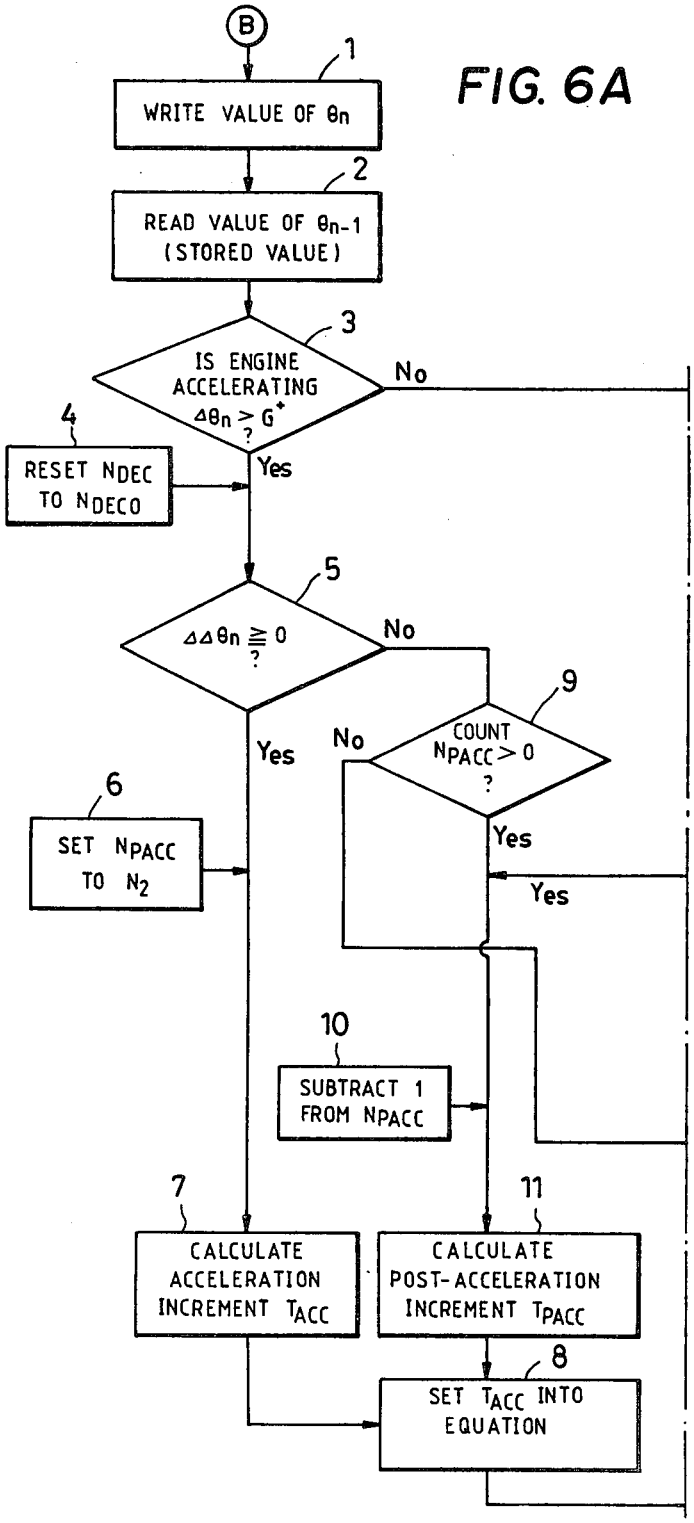
Figure 10A:
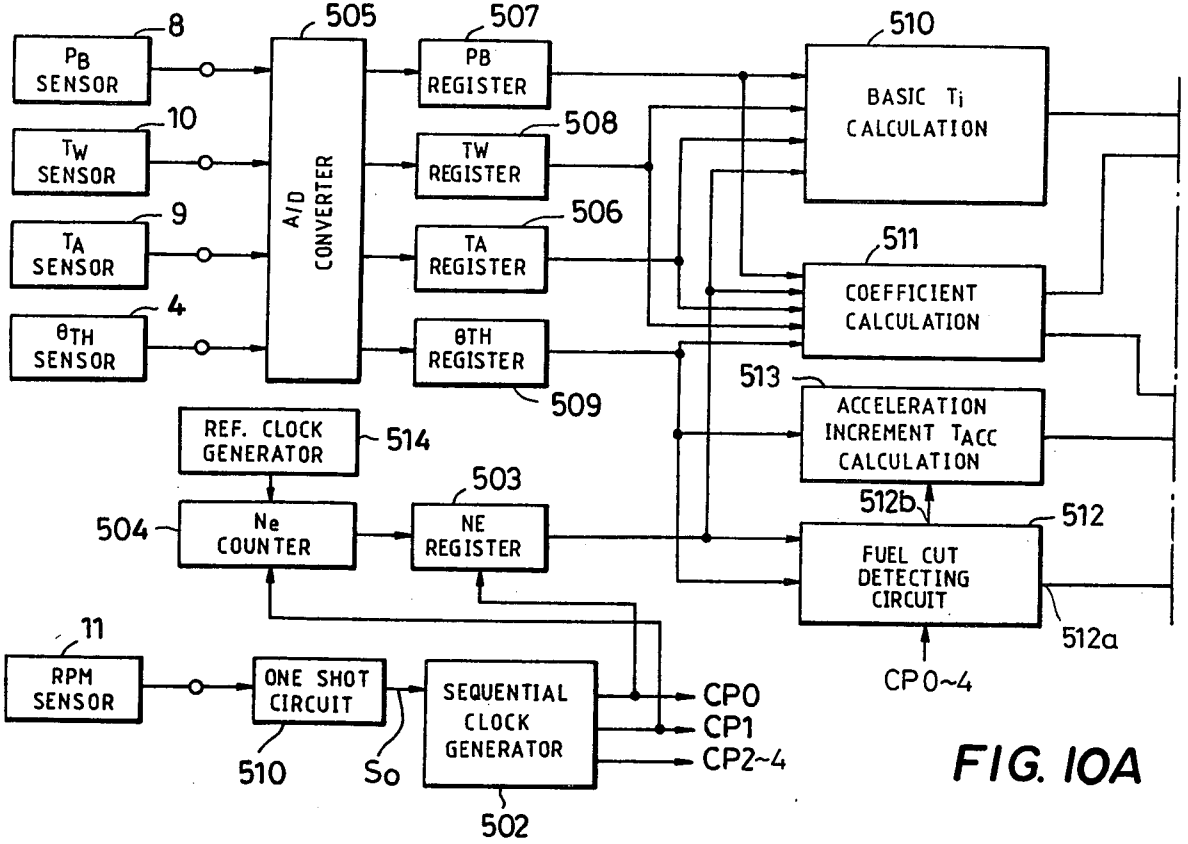
FIGS. 10A and 10B are a circuit diagram showing the electrical circuit within the ECU, in FIG. 1.
Figure 10B:
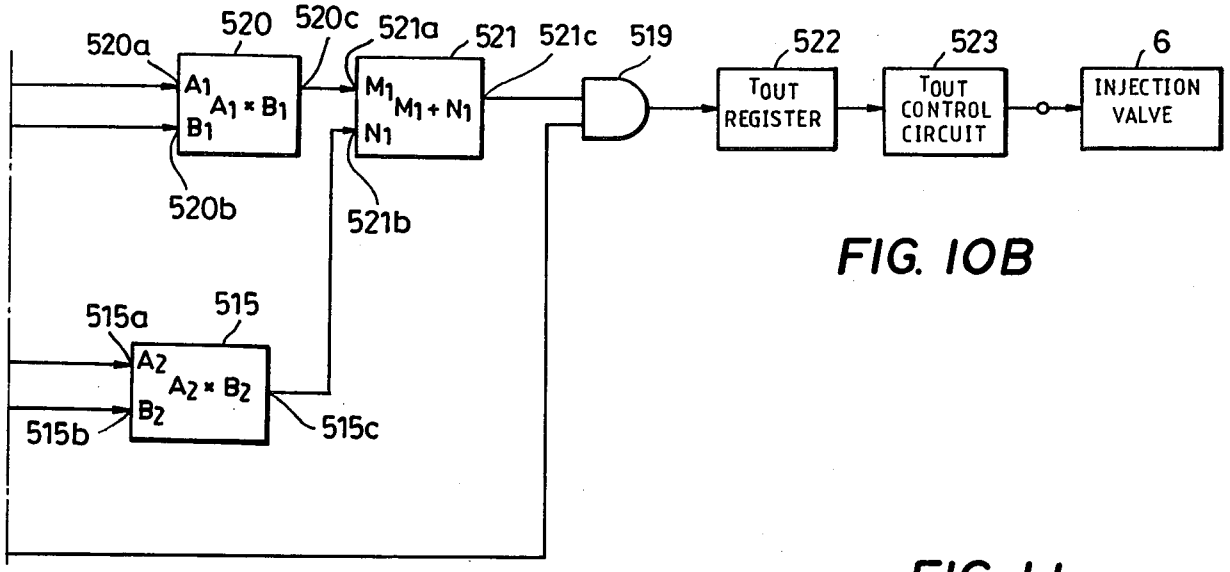

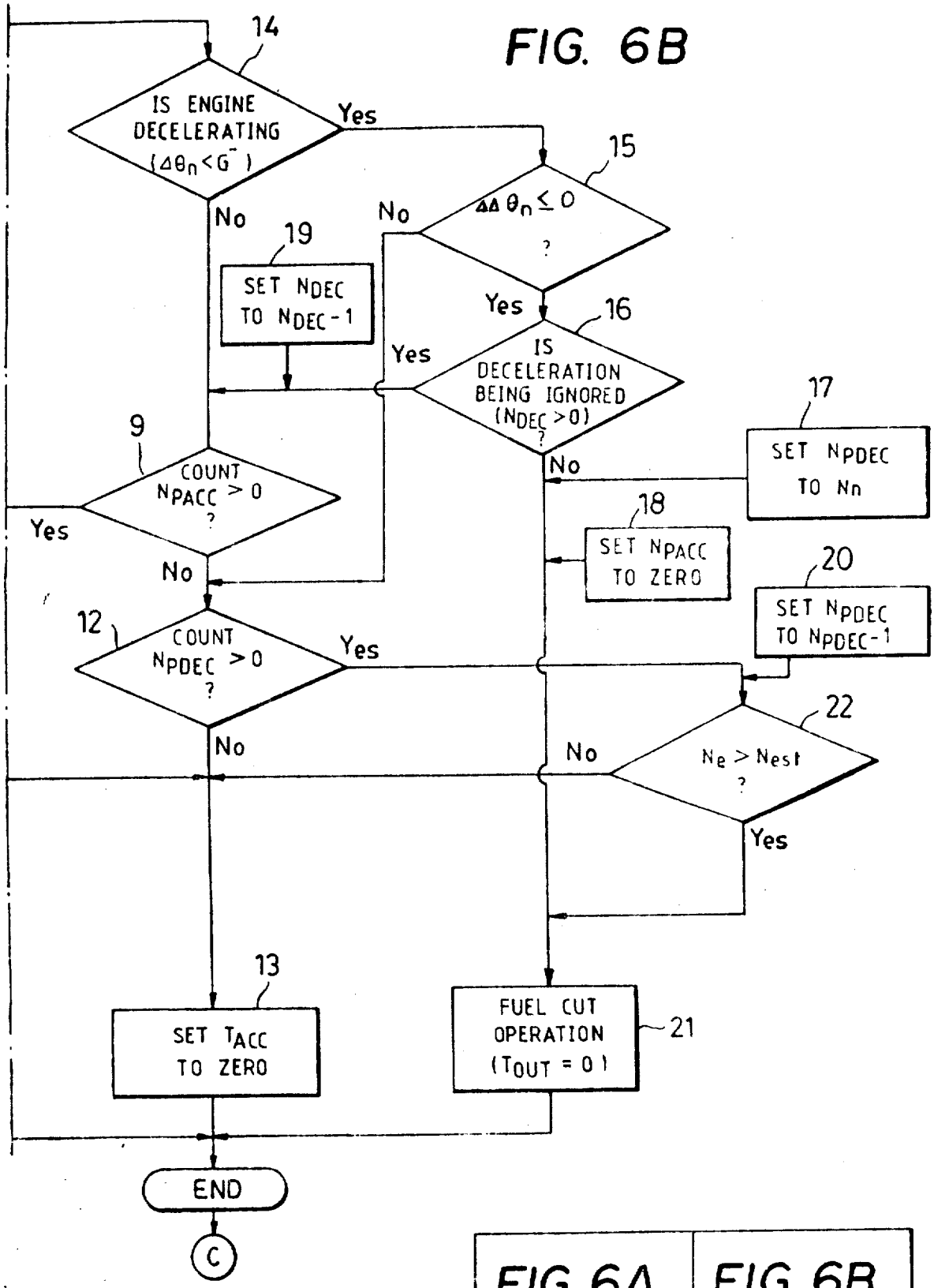
| FIG. 6A | FIG. 6B |
|---|---|